US006176716B1

(12) United States Patent
Mercurio et al.

(10) Patent No.: US 6,176,716 B1
(45) Date of Patent: Jan. 23, 2001

(54) INTERCHANGEABLE ELECTRICAL CONNECTOR

(75) Inventors: Gregory A. Mercurio, Vacaville; Richard N. Marsh, Cool; Demian T. Martin, Oakland, all of CA (US)

(73) Assignee: Monster Cable Products, Inc., Brisbane, CA (US)

( * ) Notice: Under 35 U.S.C. 154(b), the term of this patent shall be extended for 0 days.

(21) Appl. No.: 09/405,727

(22) Filed: Sep. 24, 1999

Related U.S. Application Data

(63) Continuation-in-part of application No. 08/890,695, filed on Jul. 11, 1997.

(51) Int. Cl.[7] ..... H01R 29/00
(52) U.S. Cl. ..... 439/166; 439/891
(58) Field of Search ..... 439/166, 168, 439/170, 172, 173, 174, 175, 891

(56) References Cited

U.S. PATENT DOCUMENTS

| | | | | |
|---|---|---|---|---|
| 4,367,001 | * | 1/1983 | Munakata | 339/31 R |
| 4,405,196 | | 9/1983 | Fulton | 339/273 |
| 4,772,223 | * | 9/1988 | Yasumoto | 439/578 |
| 4,891,015 | * | 1/1990 | Oldfield | 439/172 |
| 4,944,686 | | 7/1990 | Gertz | 439/175 |
| 5,087,209 | * | 2/1992 | Faucher | 439/320 |
| 5,439,391 | * | 8/1995 | Mcetchin et al. | 439/518 |
| 5,662,489 | | 9/1997 | Stirling | 439/322 |
| 5,791,919 | | 8/1998 | Brisson et al. | 439/166 |
| 5,833,490 | * | 11/1998 | Bouldin | 439/462 |
| 5,984,696 | * | 11/1999 | Lee | 439/79 |

* cited by examiner

*Primary Examiner*—Lincoln Donovan
*Assistant Examiner*—Kyung S. Lee
(74) *Attorney, Agent, or Firm*—Lariviere, Grubman & Payne, LLP

(57) ABSTRACT

An interchangeable electrical connector includes a connector body and an adapter body. The connector body includes electrical contact means, such as a banana plug tip, for engaging an electrical terminal. The connector body includes a conical portion and a threaded portion which is coaxial with the conical portion. The adapter body includes a conical portion which is shaped for co-operative engagement with the conical portion of the connector body, and a threaded portion which is coaxial to the conical portion of the adapter body. The threaded portion of the adapter body is for cooperative engagement with the threaded portion of the connector body, such that cooperative rotation of the connector body relative to the adapter body draws the conical portion of the connector body into engagement with the conical portion of the adapter body. The wedging action of the two conical portions frictionally engages the connector body to the adapter body.

8 Claims, 5 Drawing Sheets

INTERCHANGEABLE ELECTRICAL CONNECTOR

RELATED APPLICATIONS

This application is a continuation-in-part of U.S. patent application Ser. No. 08/890,695 filed Jul. 11, 1997.

TECHNICAL FIELD

The present invention relates to an electrical connector which permits the user of an electrical cable to interchange a number of conventional cable connector ends in a modular fashion, depending on the particular requirements of the terminal to which the cable is to be connected.

BACKGROUND OF THE INVENTION

Manufacturers and retailers of electrical cables are presented with the problem that electrical equipment is manufactured with a variety of different terminals to which the electrical cables are to be connected. To ensure that an end user's needs will be met, the cable manufacturer either has to make a wide range of products differing only in the connectors used, or the retailer or end user has to fit the particular connector required by the electrical equipment. This places additional burdens on the manufacturer and the retailer, and is often inconvenient for the end user.

This is particularly true in the professional and home audiovisual arts, where cabling and interconnects are sophisticated and expensive.

Existing modular connectors have been found to provide unsatisfactory signal transmission and unreliable physical connection.

Accordingly, there is a need for an electrical connector which permits the rapid interchange of conventional connector ends, while providing a secure and reliable electrical connection.

SUMMARY OF THE INVENTION

According to the invention there is provided an interchangeable electrical connector comprising a connector body and an adapter body.

The connector body includes a conical portion, and a threaded portion which is coaxial with the conical portion. The connector body also includes electrical contact means located at an end thereof, for engaging an electrical terminal.

The adapter body includes a conical portion which is shaped for co-operative engagement with the conical portion of the connector body, and a threaded portion which is coaxial to the conical portion of the adapter body. The threaded portion of the adapter body is for cooperative engagement with the threaded portion of the connector body in use, whereby cooperative rotation of the connector body relative to the adapter body draws the conical portion of the connector body into engagement with the conical portion of the adapter body.

A wedging action results when the two conical portions are drawn into contact by the screw threads. This wedging action frictionally engages the connector body to the adapter body, and ensures a reliable electrical and physical connection.

The connector body may be provided with any one of a number of electrical contact means such as a banana plug tip, or a spade type electrical contact.

Other features of the invention are disclosed or apparent in the section entitled "BEST MODE OF CARRYING OUT THE INVENTION"

BRIEF DESCRIPTION OF THE DRAWINGS

For fuller understanding of the present invention, reference is made to the accompanying drawings in the following detailed description of the Best Mode of Carrying Out the Invention. In the Drawings.

BEST MODE OF CARRYING OUT THE INVENTION

As electrical connectors are well-known in the art, in order to avoid confusion, while enabling those skilled in the art to practice the claimed invention, this specification omits many details with respect to known items.

For the purposes of this patent specification and claims, the term "conical" shall be interpreted to include "frusto-conical", and shall further be interpreted to include a conical segment.

Figure 1:
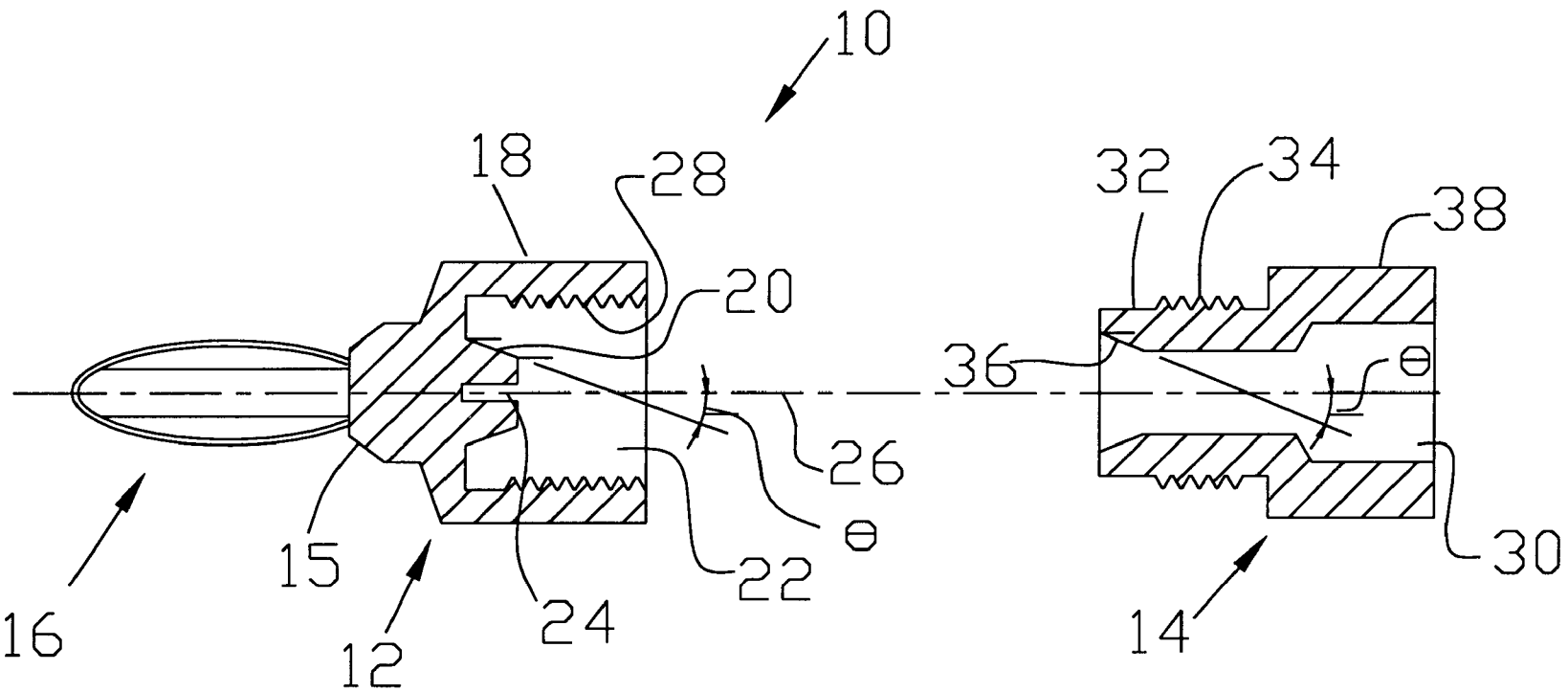
FIG. 1 is a longitudinal cross-sectional view of a first embodiment of an interchangeable electrical connector according to the invention.

FIG. 1 illustrates the a first embodiment of an electrical connector according to the invention. The electrical connector, generally indicated by the numeral 10, comprises a connector body 12 and an adapter body 14. Located at the front end 15 of the connector body 12 is an electrical contact means in the form of a banana plug tip 16.

The banana plug tip 16 comprises a series of longitudinally extending spring members, which in use engage the interior of a corresponding female socket or terminal, in a manner well known in the art.

The rear end of the connector body 12 comprises a cylindrical tubular wall 18 and a male conical portion 20. The conical portion 20 is located in a recess 22 defined by the wall 18, and has a hole 24 defined therein. The hole 24 provides a region wherein a center insulator of a cable can be received.

Formed on the interior surface of the wall 18 are screw threads 28, whereby the adapter body 14 is drawn into engagement with the connector body 12, as described below.

As can be seen from FIG. 1, the longitudinal axis of a cylinder defined by the screw threads 18, and the longitudinal axis of the conical portion 20 coincide, i.e., the conical portion 20 and the screw threads 20 are coaxial about the longitudinal axis 26 of the connector body 12.

The adapter body 14 is generally cylindrical in shape, and has a bore 30 defined therein. The front end 32 of the adapter body 14 has screw threads 34 defined therein. The screw threads 34 have a pitch and effective diameter which are chosen to provide cooperative engagement with the screw threads 28 defined in the rear end of the connector body 12.

Defined in the front end 32 of the adapter body 14 is a female conical portion 36 which forms part of the bore 30. The conical portion 36 is shaped for co-operative mating engagement with the conical portion 20 of the connector body 12. In other words, the angle θ illustrated in the Figure is substantially the same for both conical portions 20, 36, and the respective sizes of the conical portions 20, 36 are complementary.

The angle θ may vary between different electrical connectors according to the invention, but in the illustrated embodiment, θ is approximately 27.5°, and is preferably between 0° and 90°, and more preferably between 0° and 45°. Also, the angle θ for the the conical portion 20 may differ by a small amount from the angle θ for the conical portion 36. In the preferred embodiment of an electrical connector incorporating such a difference, the difference is approximately 3°. This difference between the two angles is believed to provide an improved interference between the two conical portions 20 and 36, which further assists in preventing loosening of the connector body 12 and the adapter body 14 from one another in use.

As with the connector body 12, the longitudinal axis of a cylinder defined by the adapter body screw threads 34, and the longitudinal axis of the conical portion 36 coincide, i.e., the conical portion 36 and the screw threads 34 are coaxial about the longitudinal axis 26 of the adapter body 14.

The outer surface of the rear end 38 of the adapter body 14 has approximately the same diameter as the outer surface of the wall 18 of the connector body 12, so that when the connector 10 is assembled in use, the outer surface of the connector 10 is smooth and uniform.

The bore 30 at the rear end 38 of the adapter body 14 is shaped and sized to receive an end of an electrical conductor such as a speaker cable or audio-visual interconnect cable. Such a cable may be soldered, welded or crimped into place in the bore 30.

The bore 30 has a narrower portion defined in the middle thereof which will prevent an appropriately sized cable from being inserted too far into the adapter body 14. This assists in determining the correct depth of insertion for the cable during assembly of the adapter body 14 to the cable end.

In use, the rear end 38 of the adapter body 14 is secured to the end of an electrical conductor such as a loudspeaker cable. The user selects an appropriate connector body 12 based on which electrical contact means, in this case the banana plug tip 16, is required for the task at hand.

The front end 32 of the adapter body 14 is inserted into the recess 22 defined in the rear end of the connector body 12, thereby to bring the screw threads 34 and 28 into engagement with each other. The connector body 12 is then rotated relative to the adapter body 14 about the longitudinal axis 26, until the conical portion 20 of the connector body 12 is brought into engagement with the conical portion 36 of the adapter body 14. The relative rotation is continued until a "hand tight" or "finger tight" connection is obtained. The banana plug tip 16 can then be inserted into an electrical socket.

The advantage of using a configuration as described above is that the longitudinal forces resulting from the screwing together of the connector body 12 and the adapter body 14 cause strong transverse clamping forces at 20 and 36, as a result of the conical wedging action of the cooperating conical surfaces 20 and 36. This provides good electrical contact between the connector body 12 and the adapter body 14 for signal transmission. Also, as a result of the relatively large transverse clamping forces, correspondingly large frictional forces arise at the interface of the conical surfaces, which provides a reliable physical connection.

Of course, should the user require another electrical contact means at the end of the cable, the connector body 12 may be removed by unscrewing it from the adapter body 14, and it can easily be replaced by another connector body having the appropriate electrical contact means.

The electrical connector of the invention has the advantage that a cable supplier need manufacture and supply only one cable with an adapter body 14 secured at one or both ends thereof, together with a number of connector bodies 12 having different electrical contact means at the front thereof. This simplifies production and distribution for the manufacturer, while providing the customer with a more versatile product.

Figure 2:
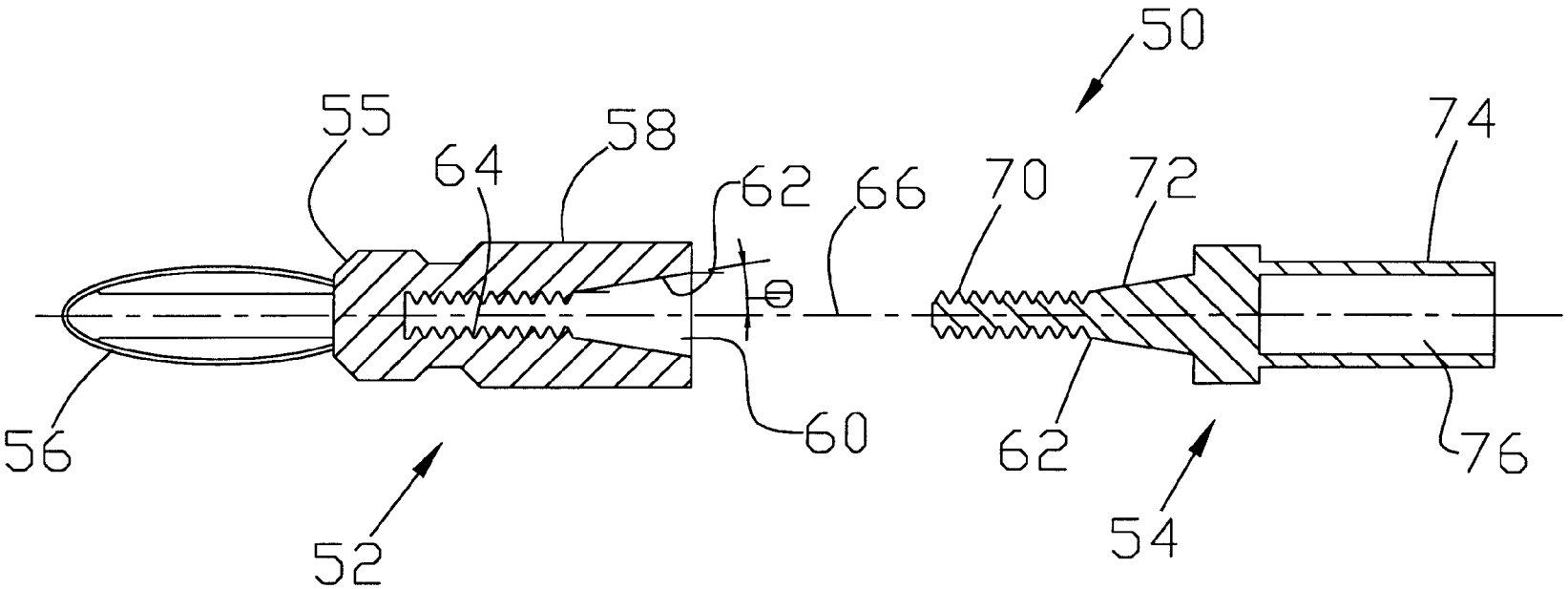
FIG. 2 is a longitudinal cross-sectional view of a second embodiment of an interchangeable electrical connector according to the invention.

The best mode embodiment of an electrical connector according to the invention is illustrated in FIG. 2. The electrical connector, generally indicated by the numeral 50, again comprises a connector body 52 and an adapter body 54. Located at the front end 55 of the connector body 52 is an electrical contact means, again in the form of a banana plug tip 56.

The rear end 58 of the connector body 52 has a bore 60 defined therein for receiving the front end of the adapter body 54. The outer portion of the surface defining the bore is formed as a female conical portion 62, while the inner portion of the surface defining the bore is formed with screw threads 64.

As can be seen from the Figure, the longitudinal axis of a cylinder defined by the screw threads 64, and the longitudinal axis of the conical portion 62 coincide, i.e., the conical portion 62 and the screw threads 64 are coaxial about the longitudinal axis 66 of the connector body 52.

The front end of the adapter body 54 comprises a dowel 68. The forward portion of the dowel 68 is formed with screw threads 70, which have the same pitch and effective diameter for cooperative engagement with the screw threads 64 defined in the rear end of the connector body 52.

Adjacent to the screw threads 70, the dowel 68 is tapered to define a male conical portion 72. The conical portion 72 is shaped for co-operative mating engagement with the conical portion 62 of the connector body 52, as in the FIG. 1 embodiment Again, the conical portions 62, 72 respectively define an angle θ which may vary between different electrical connectors according to the invention, but in the illustrated embodiment, θ is approximately 3° for the connector body 52 and 4.5° for the adapter body 54. The angles θ for the connector body 52 and the adapter body 54 can be between 0° and 90°, but are preferably between 0° and 45°.

As described above with reference to the FIG. 1 embodiment, Applicants' believe that, by providing a difference between the angles θ for the connector body 52 and the adapter body 54, an improved interference between the two conical portions 24 and 36 results, which assist in the prevention of the loosening of the connector body 52 and the adapter body 54 from one another in use.

As with the connector body 52, the longitudinal axis of a cylinder defined by the adapter body screw threads 70, and the longitudinal axis of the conical portion 72 coincide, i.e., the conical portion 72 and the screw threads 70 are coaxial about the longitudinal axis 66 of the adapter body 54.

The rear end 74 of the adapter body 54 is tubular in shape, and defines a blind bore 76 which is shaped and sized to receive an end of an electrical conductor such as a speaker cable or audio-visual interconnect cable, which in use is soldered, welded or crimped into place in the bore 76.

In use, the user again selects an appropriate connector body 52 based on the required electrical contact means, in this case the banana plug tip 56.

The front end of the adapter body 54 is inserted into the bore 60 defined in the connector body 52 until the screw threads 64 and 70 are brought into engagement with each other. The connector body 52 is then rotated relative to the adapter body 54 about the longitudinal axis 66, until the conical portion 62 of the connector body 52 is brought into engagement with the conical portion 72 of the adapter body 54. The relative rotation is continued until a "hand tight" or "finger tight" connection is obtained.

The combined action of the screw threads 64, 70 and the conical surfaces 72, 62 again provides the conical wedging forces, and the advantages associated therewith, described above with reference to the FIG. I embodiment of the invention.

Figure 3:
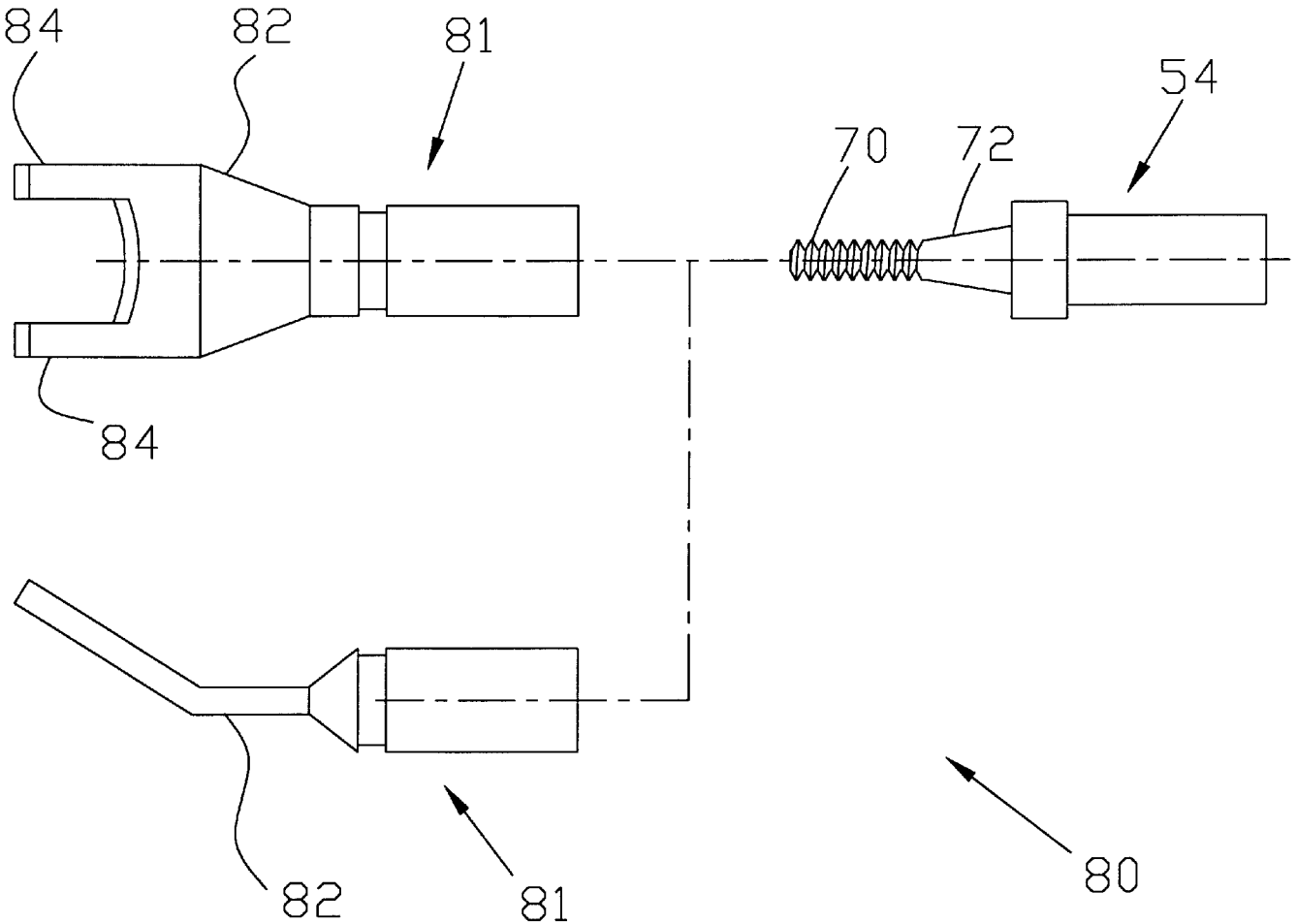
FIG. 3 is a side view of the interchangeable electrical connector of FIG. 2 including a spade electrical contact at the front end of the connector body.

FIG. 3 shows an interchangeable electrical connector 80 which is identical to the electrical connector 50 illustrated in FIG. 2, except that the electrical connection means at the front of the connector body 81 is a spade electrical contact 82. The spade contact 82, which is shown in two views in FIG. 3, is conventional in nature, and comprises and angled place with two prongs 84. In use, the prongs 84 are placed around a threaded post extending from an electrical terminal, and a fastener is screwed down the post, thereby to clamp the spade contact 84 to the electrical terminal.

It will be appreciated that the connector body 81 with the spade contact 82 is readily interchangeable with the connector body 52 with the banana plug tip 56, depending on the required application. In this regard, a number of different electrical contact means may be provided in addition to the banana plug tip 56 and spade contact 82.

The electrical connectors 10, 50 and 80 are made from conventional materials used in the connector field, and are made using conventional manufacturing techniques.

In an alternative application of the adapter body 54, the front end 68 of the adapter body 50 can be inserted directly into a female electrical terminal. In this regard, a shallow groove of rectangular cross section is defined in the dowel 68 between the screw threads 70 and the conical portion 72. This groove is provided so that the adapter body 50 can be inserted into locking engagement with a particular type of socket, which has one or more blades which are adapated to fit into the groove, thereby to retain the adapter body 50 in the socket.

Figure 4:
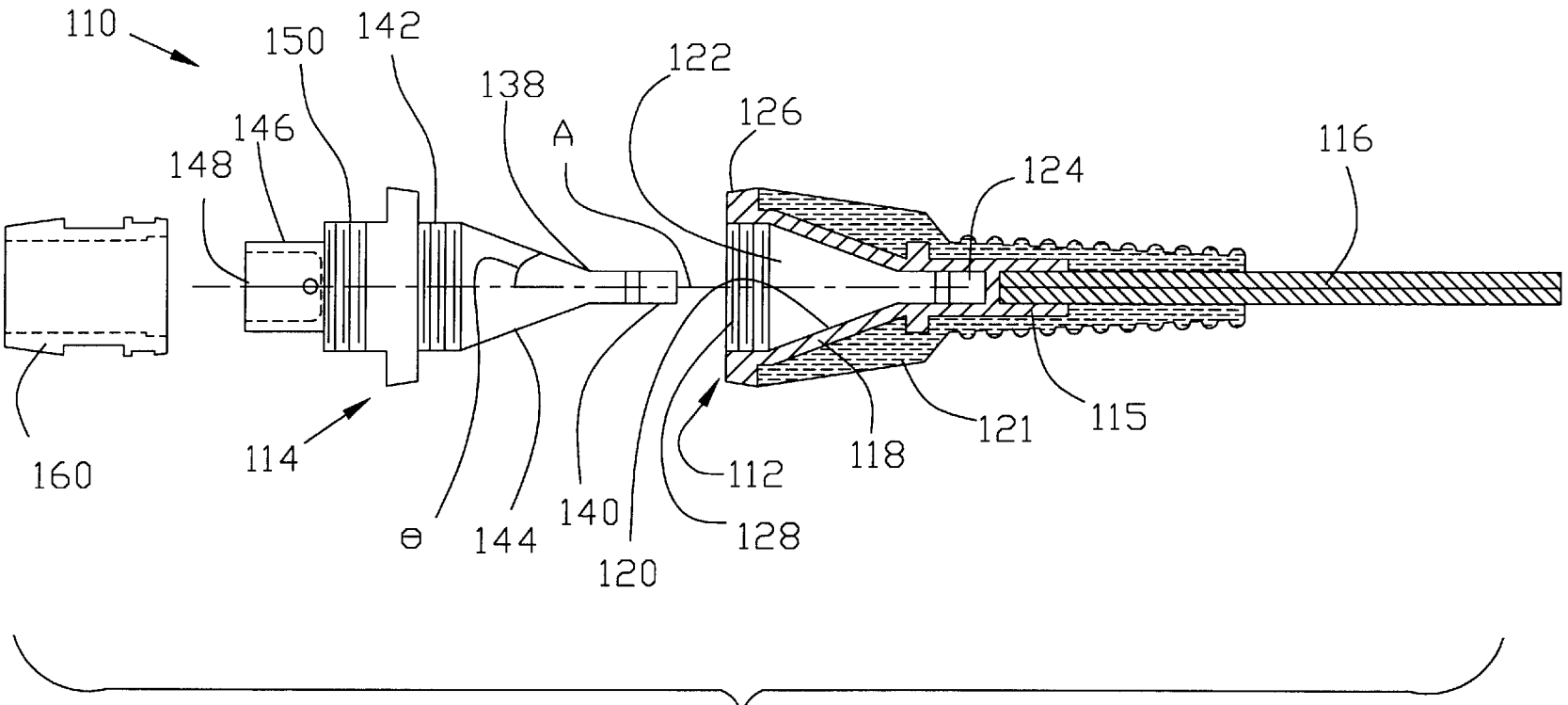
FIG. 4 is a exploded view of another embodiment of the invention.
Figure 5:
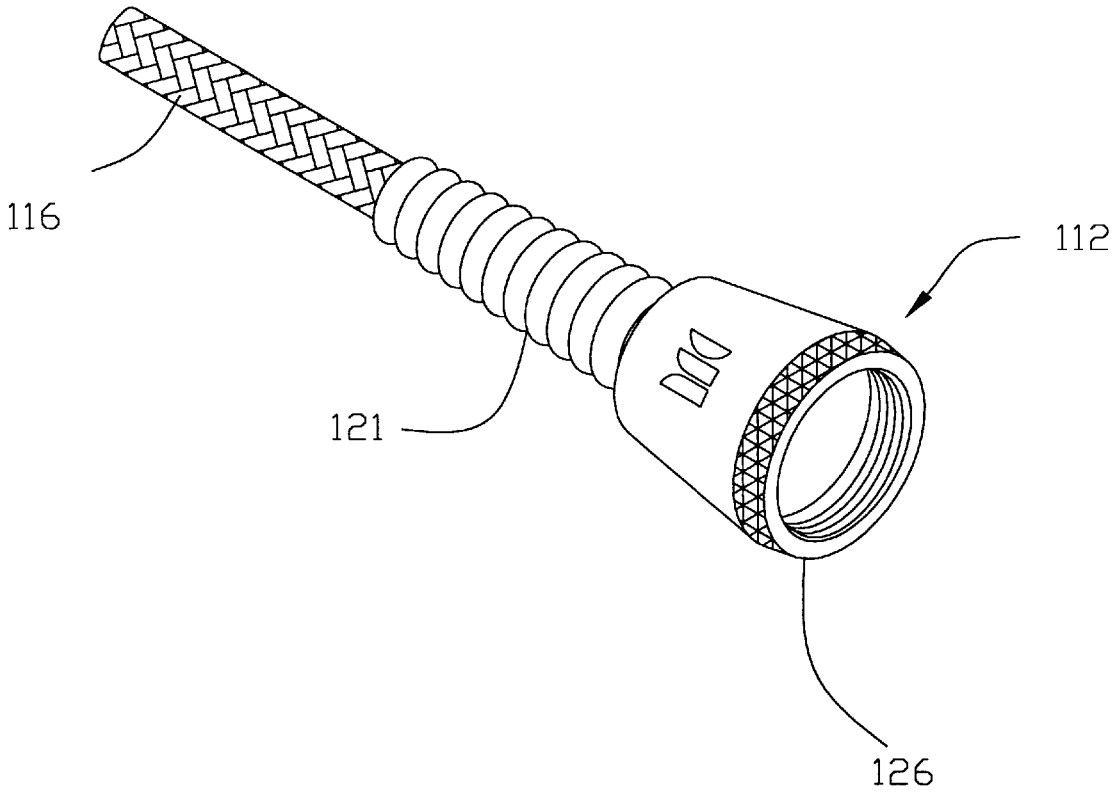
FIG. 5 is a perspective view of a connector body used in the embodiment shown in FIG. 4.

FIG. 4 is an exploded view of a partially cut away view of another embodiment of the invention. The electrical connector generally indicated by the numeral 110, comprises a connector body 112, shown as a cross-sectional view, and an adapter body 114, shown as a side view. FIG. 5 is a perspective view of the connector body 112. Located at the front end 115 of the connector body 112 is an electrical contact means. In this embodiment of the invention, the electrical contact means is an uninsulated wire 116. In this embodiment the uninsulated wire 116 is a flexible braided wire 116, made of many small copper flexible wires braided into a single flexible gold plated wire, which is able to be crimped onto an electrical component of an electrical system. The rear end of the connector body 112 comprises a cylindrical tubular wall 118 with a bore 122 defined by the wall 118. The inner side of the tubular wall 118, forming the bore 122, defines screw threads 128 at the rear end (or the outer portion) of the bore 122 and a female conical portion 120 at the inner portion of the bore 122 and a hole 124 at the most inner portion of the bore 122. A lip 126 is formed on the outer and rear part of the tubular wall 118. A longitudinal axis A is defined by the tubular wall 118. The longitudinal axis A is also the axis for the screw threads 128 and the female conical portion 120. A rubber boot 121 is placed around the connector body 112 and the uninsulated wire 116, extending from the lip 126 to the uninsulated wire 116.

The front end of the adapter body 114 comprises a dowel 138. The forward portion of the dowel 138 forms a pin 140. Since the pin 140 is formed from the dowel 138, the pin 140 is electrically connected to the dowel 138. The rear portion of the dowel 138 is formed with screw threads 142 which have the same pitch and effective diameter for cooperative engagement with the screw threads 128 of the connector body 112. Between the screw threads 142 of the dowel 138 and the pin 140 is a tapered part of the dowel 138 forming the male conical portion 144. The male conical portion 144 is shaped for co-operative mating engagement with the female conical portion 120 of the connector body 112. The conical portions 120, 144 define an angle θ, which are approximately equal to each other and which are about 33°. The rear end 146 of the adapter body 114 is tubular in shape, and defines a blind bore 148 which is shaped and sized to receive an end of an electrical conductor such as a speaker cable or audio-visual interconnect cable, which in use is soldered, welded or crimped into place in the bore 148. Sleeve threads 150 surround the rear end 146.

An outer sleeve 160 is cylindrical in shape and formed to engage the sleeve threads 150 and surround the rear end 146 of the adapter body 114.

In use, the user again selects an appropriate connector body 112 based on the required electrical contact means, in this case am uninsulated wire 116. The front end of the adapter body 114 is inserted into the bore 122 defined by the tubular wall 118 of the connector body 112 until the screw threads 128, 142 are brought into engagement with each other. The pin 140 and the conical portions 120, 144 act as guides, guiding the connector body 112 and the adapter body 114 together. The pin 140 extends into the hole 124 and is co-operatively engageable with the hole 124, since the pin 140 has approximately the same diameter as the hole 124. The connector body 112 is then rotated relative to the adapter body 114 about the longitudinal axis A, until the female conical portion 120 of the connector body 112 is brought into engagement with the male conical portion 144 of the adapter body 114 to maximize contact area to reduce resistance, improve signal transfer, and heighten sonic performance. The relative rotation is continued until a "hand tight" or "finger tight" connection is obtained.

The combined action of the screw threads 128, 142 and the conical surfaces 120, 144 again provide the conical wedging forces, and the advantages associated therewith. Since the threads 128 and female conical portion 120 are on the same connector body 112 so that they rotate together (not independently), and since the threads 142 and male conical portion 144 are on the same adapter body 114 so that they rotate together (not independently), the conical wedging forces created when the male conical portion 144 and female conical portion 120 engage with each other helps to hold the threads 128, 142 in engagement. If the one set of threads could be rotated independently of the associated conical portion, the conical wedging forces would not be as helpful in keeping the thread engaged.

It will be appreciated that the invention is not limited to the embodiment of the invention described above, and many modifications are possible without departing from the spirit and the scope of the invention.

What is claimed is:

1. An interchangeable electrical connector, comprising:

a connector body having a front end, a rear end, and a longitudinal axis, the rear end of the connector body having a bore, the bore defining a female conical portion being axially aligned with the longitudinal axis of the connector body, and the bore further defining screw threads to the rear of the female conical portion; and an adapter body having a front end, a rear end, and a longitudinal axis, the rear end of the adapter body being adapted for engagement with an electrical conductor, the front end of the adapter body defining a dowel, the dowel defining a male conical portion being shaped for cooperative engagement with the female conical portion of the connector body, the dowel further defining screw threads to the rear of the male conical portion, the screw threads of the dowel being formed for co-operative engagement with the screw threads of the connector body, rotation of the connector body relative to the adapter body drawing the female conical portion of the connector body into engagement with the male conical portion of the adapter body, said connector body female conical portion being defined by a taper in an angular range of 7° to 45°, said adapter body conical male portion being defined by a taper in an angular range of 7° to 45°, said connector body female conical portion taper being less than said adapter body male conical portion taper by a taper difference in an angular range of at least 0° to 3°, whereby a wedging action is effected, and thereby providing an interference fit between said connector body female conical portion and said adapter body conical male portion.

2. The interchangeable electrical connector, as recited in claim 1, wherein the bore of the connector body forms a hole at the front end of the bore, wherein the dowel of the adapter body forms a pin at the front end of the dowel, and wherein the pin is cooperatively engageable with the hole.

3. The interchangeable electrical connector, as recited in claim 2, wherein the adapter body male conical portion and the connector body female conical portion each have a taper angle of about 33°.

4. The interchangeable electrical connector, as recited in claim 3, wherein the front end of the connector body comprises an uninsulated wire.

5. The interchangeable electrical connector, as recited in claim 3, further comprising a rubber boot, said rubber boot surrounding the connector body.

6. The interchangeable electrical connector, as recited in claim 1, wherein the screw threads of the connector body rotate together with the connector body female conical portion, and wherein the screw threads of the adapter body rotate together with the adapter body male conical portion.

7. The interchangeable electrical connector, as recited in claim 6, wherein the connector body female conical portion has substantially the same taper angle as the adapter body male conical portion.

8. The interchangeable electrical connector, as recited in claim 6, wherein the adapter body male conical portion and the screw threads of the adapter body are concentrically aligned with the longitudinal axis of the adapter body.

* * * * *